US009702678B1

(12) United States Patent
Moretti et al.

(10) Patent No.: US 9,702,678 B1
(45) Date of Patent: Jul. 11, 2017

(54) ARMOR PIERCING INCENDIARY PROJECTILE

(71) Applicant: The United States of America, as represented by the Secretary of the Army, Washington, DC (US)

(72) Inventors: Jared D. Moretti, Randolph, NJ (US); Jesse J. Sabatini, Bel Air, MD (US); Gary Chen, Succasunna, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/072,979

(22) Filed: Mar. 17, 2016

Related U.S. Application Data

(63) Continuation-in-part of application No. 13/752,444, filed on Jan. 29, 2013, now abandoned.

(51) Int. Cl.

| | |
|---|---|
| ***C06B 33/00*** | (2006.01) |
| ***C06B 33/06*** | (2006.01) |
| ***D03D 23/00*** | (2006.01) |
| ***D03D 43/00*** | (2006.01) |
| ***F42B 12/44*** | (2006.01) |
| ***F42B 12/04*** | (2006.01) |
| ***F42B 12/40*** | (2006.01) |

(52) U.S. Cl.
CPC ..... *F42B 12/44* (2013.01); *F42B 12/04* (2013.01); *F42B 12/40* (2013.01)

(58) Field of Classification Search
USPC ..... 149/41, 37, 42, 108.6, 109.2, 109.4
See application file for complete search history.

(56) References Cited

U.S. PATENT DOCUMENTS

| | | | | |
|---|---|---|---|---|
| 2,398,287 A * | 4/1946 | Christie | F42B 12/44 | 102/364 |
| 3,788,908 A * | 1/1974 | Franklin | C06B 27/00 | 102/513 |
| 6,808,572 B2 * | 10/2004 | Miskelly, Jr. | C06B 23/007 | 102/287 |

* cited by examiner

*Primary Examiner* — James McDonough
(74) *Attorney, Agent, or Firm* — Lisa H. Wang

(57) ABSTRACT

An improved armor piercing and pyrotechnic projectile for use in .50" military caliber rounds. Such projectiles contain a core, jacket, a base and a hollow nose housing pyrotechnic mixtures composed of sodium periodate and magnalium. The improved projectiles exhibit increased luminosity, and are non-toxic, safer, and environmentally benign compared to current state-of-the-art projectiles.

3 Claims, 1 Drawing Sheet

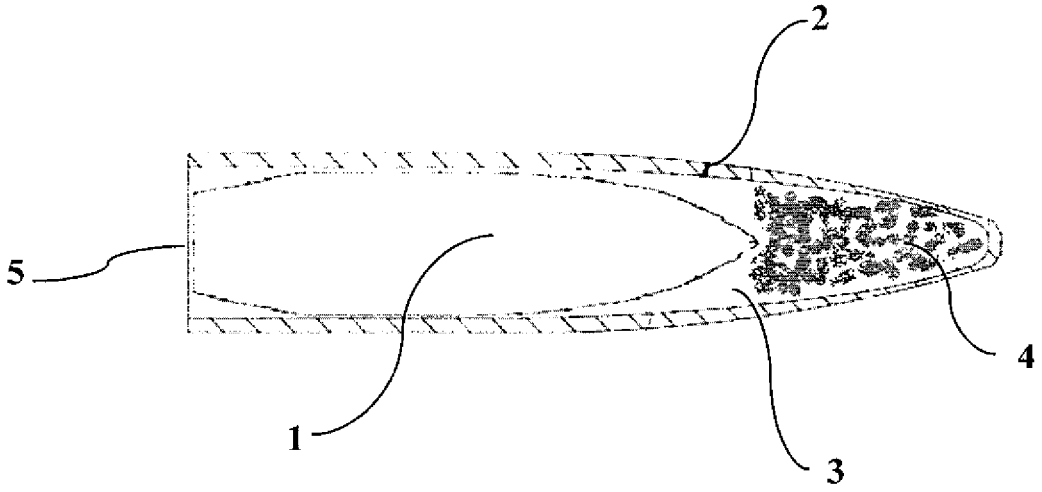
2
5
1
3
4

ARMOR PIERCING INCENDIARY PROJECTILE

CROSS REFERENCE TO RELATED APPLICATIONS

The present application is a continuation-in-part application that claims the benefit of pending non-provisional patent application entitled "Armor Piercing Projectile Incendiary Composition" filed Jan. 29, 2013, as Ser. No. 13/752,444.

FEDERAL RESEARCH STATEMENT

The inventions described herein may be manufactured, used and licensed by, or for, the U.S. Government, for U.S. Government purposes.

FIELD OF THE INVENTION

The present invention relates to armor piercing projectiles containing improved incendiary compositions having mixtures of sodium periodate and magnalium. Such projectiles have improved performance over state of the art compositions with the added benefit of being non-toxic and environmentally safe.

BACKGROUND OF THE INVENTION

The U.S. military utilizes M2 and M85 machine guns, firing fifty caliber (hereinafter '.50" caliber') projectiles, to penetrate and destroy hard targets at long ranges, up to and about 800 meters. The .50" caliber projectiles including M2 armor piercing rounds are designed to penetrate light-armored vehicles or breach hard unarmored targets such as concrete walls or shelters.

Other .50" caliber projectiles, such as the M1 or M23 incendiary rounds contain an incendiary composition, such that upon impact the composition bursts into flame, to ignite any flammable material in proximity thereof. These incendiary rounds may be used against aircraft.

Certain .50" machine gun projectiles of particular interest include the M8 armor piercing incendiary (API) round and the MK257 armor piercing incendiary dim tracer (API-DT) round, which rounds combines the functionality of the M2 armor piercing round and the M1/M23 incendiary rounds; so as to be useful against hard targets containing a flammable component, such as lightly armored targets containing volatile fuels, e.g. aviation fuel, gas, diesel fuel, etc. Upon impact with such a hard target, the M8/MK257 round will penetrate the target, the kinetic energy of the impact is converted by friction to heat which causes an incendiary material within the projectile to ignite, such as U.S. incendiary composition IM-11 (50% barium nitrate and 50% powdered aluminum/magnesium alloy) or IM-28. Importantly, in addition to providing a means for igniting flammable materials, including fuel vapors, in or about the target; the ignition of the incendiary provides an incandescent flash, which is very useful for marking the impact point—as a pyrotechnic signal to other military units.

The M8 API, MK257 (API-DT) and other similar in-service U.S. military incendiary projectiles, such as the 20 mm PGU-28/B semi armor piercing high explosive incendiary (SAPHEI) and the 20 mm M940 multi-purpose tracer with self destruct (MPT-SD) round, contain potassium perchlorate ($KClO_4$) and/or barium nitrate, as an oxidizer, within their oxidizer/fuel incendiary composition. These compounds however, have been associated with toxic effects in humans. For instance, potassium perchlorate has been associated with increasing thyroid dysfunction and teratogenicity while barium nitrate has been reported as being cardiotoxic. Further, while recent work has shown that sodium nitrate ($NaNO_3$) can be a substitute for such environmentally toxic oxidizers, the hygroscopic nature of $NaNO_3$ promotes agglomeration upon exposure to water vapor in the air which poses risks during manufacturing and affects performance of the pyrotechnic projectiles.

Therefore, a need exists in the art for a less toxic alternative oxidizer to potassium perchlorate and barium nitrate in armor piercing incendiary projectile compositions—an alternative that does not suffer from being hygroscopic. In addition, the alternative oxidizer must provide equally reliable ignition, burn time and pyrotechnic visual intensity to the current incendiaries based on barium nitrate and potassium perchlorate oxidizers.

SUMMARY OF INVENTION

The present invention provides an economical, non-hygroscopic, non-toxic and environmentally safe oxidizer/fuel incendiary composition useful in incendiary .50" caliber rounds—such as the M8 API, MK257 API-DT. The oxidizer, sodium periodate ($NaIO_4$, which is also known as sodium (meta) periodate), is blended with a fuel system consisting of magnalium. Surprisingly, the luminous efficiency, i.e. the integrated luminous intensity per unit mass in $(\text{cds-grn})^{-1}$, of the flash provided by the preferred sodium periodate was almost 20% greater than the current IM-28 incendiary—with substantively corresponding burn times. Such significantly improved luminous efficiency indicates that the inventive formulation will not only provide enhanced incendiary effects; but, clearly will also provide significantly more pyrotechnic flash for a given quantity thereof, providing a significantly more observable marking of the impact point. And, finally, and also surprisingly, the impact sensitivity of the inventive incendiary formulations is significantly less than the current IM-28 incendiary—indicating that the new inventive formulation is much safer for transport and handling.

Preferred embodiments of the present inventive incendiary compositions include from about 30 to 50 weight percent of the sodium periodate oxidizer, and about 70 to about 50 weight percent of magnalium, a chemical alloy of aluminum and magnesium said magnalium comprising 10:90 to a 20:80 ratio and more preferably 50:50 ratio of aluminum to magnesium. A small quantity of a flow agent such as fumed silica (aka Cab-o-sil®) or calcium stearate at about 0.01 to about 0.05 percent of the total weight of the composition may be added prior to mixing with about 70 to about 50 weight percent magnalium. The flow agent was found to aid in the mixing of the oxidizer and fuel and creating a more uniform incendiary product and to avoid any potential undesired agglomeration.

Additional features and advantages of the present invention will be set forth in, or are apparent from, the detailed description of preferred embodiments thereof which follows.

BRIEF DESCRIPTION OF THE DRAWINGS

The invention will be better understood, and further objects, features, and advantages thereof will become more apparent from the following description of the preferred embodiments, taken in conjunction with the accompanying drawings.

The FIGURE is a cross-section of the armor piercing incendiary projectile of the present invention.

DETAILED DESCRIPTION OF THE INVENTION

Disclosed herein are armor piercing incendiary projectiles containing an incendiary composition that is an improvement over current projectiles as being less toxic and environmentally safe while having enhanced incendiary effects and pyrotechnic flash.

Generally armor piercing incendiary projectiles such as those for M8 API, MK257 APT-DT .50" caliber rounds will disperse incendiary material upon impact to disclose the location of the target as well as causing collateral damage by igniting flammable material.

The FIGURE is an illustration of an exemplary armor piercing incendiary projectile. The projectile contains a core 1, which is typically comprised of a metal such as steel or lead fitted inside a metal jacket 2. The front of the core is shorter than the jacket leaving a space at the tip of the jacket (i.e. hollow nose) when the core is seated inside the jacket. The hollow space 3 at the nose of the jacket houses the incendiary composition 4. At the rear of the jacket and core is the base 5, which may be sealed off to prevent exposure of the powder flame from the cartridge propellant to the incendiary composition. Optionally, a tracer composition may be placed on the rear of projectiles, i.e. on or near the base, to indicate the projectile's path during flight.

The incendiary composition provided herein comprises an oxidizer such as sodium periodate. The composition further comprises magnalium a binary fuel system comprising a chemical alloy of aluminum and magnesium. The incendiary composition may further comprise a flow agent such as fumed silica or calcium stearate.

The current, prior art IM-28 U.S. military incendiary composition formulation is shown in Table 1, below, wherein the $Ba(NO_3)_2$ and the $KClO_4$ serve as oxidizers and the 50:50 magnesium-aluminum alloy (magnalium) serves as the fuel.

TABLE 1

Composition of current in-service US military IM-28 incendiary

| Component | Weight Percentage (%) |
|---|---|
| $Ba(NO_3)_2$ | 40% |
| $KClO_4$ | 10% |
| magnalium | 50% |

The preferred incendiary embodiment of the present invention is shown in Table 2. As shown in the table below, the preferred weight percentage range for the oxidizer is 30-50 wt. %, 50-70% for the fuel, along with an additional 0.01 to 0.05 percent of a flow agent per the total weight of the composition.

TABLE 2

Alternative preferred embodiment of the present inventive incendiary composition.

| Component | Subject Invention 1 Weight Percentage (%) |
|---|---|
| $NaIO_4$ | 30-50 |
| magnalium | 70-50 |
| Flow agent | +0.01-0.05 |

The performance of the alternative preferred embodiments of the present incendiary composition shown in Table 2 is compared to the current state-of-the-art IM-28 incendiary composition in Table 3, below.

TABLE 3

Laboratory performance of the present invention vs. the current in-service IM-28 incendiary composition

| Formulation | Burn Time (seconds) | Luminous Efficiency ($cd \cdot s \cdot gm^{-1}$) | Impact Sensitivity (Joules) |
|---|---|---|---|
| Current IM-28 | 0.109 | 11,294 | 2.94 |
| Subject composition | 0.185 | 13,504 | 9.80 |

Table 3 illustrates that the subject composition containing $NaIO_4$ in the formulation exhibits up to about 20% more luminous efficiency vs. the current IM28 formulation. Furthermore, that exhibited brightness will appear to be enhanced because of the spectral emission corresponding to gaseous atomic sodium which gives off a more discernible yellow light than the blueish white light from the current IM-28.

As stated above, an important attribute of the present invention, containing $NaIO_4$ as the oxidizing agent, is the fact that it is non-hygroscopic. The non-hygroscopic nature of this preferred embodiment is demonstrated in Table 4, below, in relation to other common pyrotechnic oxidizers, such as $Sr(NO_3)_2$ and $NaNO_3$, known as alternatives to $Ba(NO_3)_2$ and $KClO_4$ in the present IM-28 composition.

TABLE 4

Water solubility data for current inventive preferred oxidizer vs. known nitrate oxidizer alternatives.

| Ingredient | Water Solubility [g per 100 g $H_2O$] |
|---|---|
| $NaNO_3$ | 91.2 |
| $Sr(NO_3)_2$ | 80.2 |
| $NaIO_4$ | 14.4 |

The ballistic performance of the inventive composition exceeds that of the currently specified IM-28 incendiary filler for M8 .50" caliber APIs. Table 5 below compares the performance of the subject composition and IM-28 when each is charged into actual bullets and gun-fired during the "Incendiary Flash" and "Penetration" qualification tests. These tests are part of the typical lot acceptance testing and both must be passed with the minimum scores in the "Success Criteria" column. From Table 5, it is clear that the subject composition, while being free of environmentally objectionable materials, also offers superior performance to the currently specified art.

| Qualification Test | Reference | Success Criteria | IM-28 | Subject Composition |
|---|---|---|---|---|
| Incendiary Flash | TECP 700-700, Vol. III | >70% | 93% | 96% |
| Penetration | TECP 700-700, Vol. III | >87.5% | 97.5% | 100% |

The subject preferred inventive incendiary composition was prepared by first oven drying the oxidizer(s), screening the oxidizer(s) through a 60-mesh sieve. The dried and screened oxidizer(s) was then combined with the fuel in a conductive container, and the binary mixture was dry-tumbled therein for a period of up to about 30 minutes to ensure thorough mixing/blending. The thoroughly blended composition therefrom was manually pressed into pellets for static ignition testing—to establish the reported burn times and luminous efficiencies—or subjected to a variety of physical stimuli as small, loose powder samples (ca. 20 mg)—to determine sensitivity data—or alternatively, charged as a loose powder into bullet hardware for ballistic tests. Further, as noted above, a small quantity of hydrophobic fumed silica or calcium stearate (about 0.01 to about 0.05 wt. % per total weight of composition) can be added to the oxidizer after it is screened; but, before it is blended with a metal fuel, to enhance uniformity of the resulting inventive incendiary composition—i.e. the oxidizers ability to be thoroughly mixed with the metal fuel, esp. 50/50 magnalium fuel, is enhanced. And, where the 50/50 magnalium (having a preferred mean particle diameter of about 18.4 μm) is available from Magnesium Elektron Powder Products N.A. (Reade Manufacturing Company), Manchester, N.J. 08759.

$NaIO_4$ oxidizing agent is available from William Blythe, Ltd, Lancashire, England BB5 4PD, or Alfa Aesar, a Johnson Matthey Company, located in Ward Hill, Mass. 01835—having a preferred mean particle diameter of about 61.8 μm.

The luminous efficiency, the integrated luminous intensity per unit mass, as reported above was established using a single-element photopic light detector. The light detector was manufactured by International Light and is composed of a SED 033 silicon detector (33 $mm^2$ area silicon detector with quartz window) coupled to a photopic filter (Y-filter) and a field of view limited hood (H-hood). The current output of the detector was converted to a voltage using a DL Instruments 1211 transimpedance amplifier. Voltage output was collected and analyzed form the amplifier using a NI-6115 National Instruments data card and in-house developed Labview based data acquisition and analysis software.

Ballistic test data for the subject composition were obtained by standard methods described in TECP 700-700, Volume III. For incendiary flash, 20 rounds derived from the subject composition were fabricated and gun-fired in a test tunnel. The flash resulting from each shot was recorded by high speed camera and compared to the flash silhouettes on a standard drawing. Scores ranged from 0 (no flash, "dud") to 5 (robust, bright flash) and an overall percentage was obtained by simply adding up all 20 individual scores. For .50" caliber rounds, a minimum flash score of 70% is required for lot acceptance. For the penetration tests, 20 more rounds were fabricated and gun-fired at a 1.00" thick steel plate. The terminal effect at the target plate was noted for each shot and only those shots resulting in complete perforation of the plate were credited; other outcomes such as "bulge rear no cracks," spall, or partial penetration were not credited. A final penetration score was obtained by adding the number of credited shots and multiplying by five. For .50" caliber rounds, a minimum penetration score of 87.5% is required for lot acceptance.

Although the invention has been described above in relation to preferred embodiments thereof, it will be understood by those skilled in the art that variations and modifications can be effected in these preferred embodiments without departing from the scope and spirit of the invention. Further, while specific weights or ratios may have been used by way of example/specific embodiments, it is also understood by those skilled in the art that quantities of the materials between and about the ratios are equally functional.

What is claimed is:

1. An improved armor piercing incendiary projectile comprising;

a jacket having a tip, a base and a metal core, wherein the tip comprises a hollow nose having a pyrotechnic composition consisting essentially of sodium periodate, magnalium and a flow agent, wherein the sodium periodate is about 30 to about 50 weight percent of the composition, the magnalium is about 50 to about 70 weight percent of the composition, and the flow agent is an additional 0.01 to 0.05 of the total weight of the composition.

2. The projectile of claim 1, wherein the magnalium is a chemical alloy of aluminum and magnesium at a ratio of about 1:1.

3. The projectile of claim 1, wherein flow agent is calcium stearate or fumed silica.

* * * * *